US005391456A

United States Patent [19]

Patel et al.

[11] Patent Number: 5,391,456

[45] Date of Patent: Feb. 21, 1995

[54] TONER AGGREGATION PROCESSES

[75] Inventors: Raj D. Patel, Oakville; Grazyna E. Kmiecik-Lawrynowicz, Burlington; Michael A. Hopper, Toronto; Melvin D. Croucher, St. Catharines, all of Canada

[73] Assignee: Xerox Corporation, Stamford, Conn.

[21] Appl. No.: 203,095

[22] Filed: Feb. 28, 1994

[51] Int. Cl.[6] ..... G03G 9/087

[52] U.S. Cl. ..... 430/137; 523/322; 523/335; 523/339

[58] Field of Search ..... 430/137; 523/322, 335, 523/339

[56] References Cited

U.S. PATENT DOCUMENTS

| | | | |
|---|---|---|---|
| 4,558,108 | 12/1985 | Alexandra et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,290,654 | 3/1994 | Sacripante et al. | 430/137 |
| 5,308,734 | 5/1994 | Sacripante et al. | 430/137 |

*Primary Examiner*—Roland Martin
*Attorney, Agent, or Firm*—E. O. Palazzo

[57] ABSTRACT

A process for the preparation of toner compositions comprising:

(i) forming a dispersion of resin in an aqueous ionic surfactant solution;

(ii) preparing pigment dispersions in water of three different pigments each of a dissimilar color, each dispersion being comprised of a pigment dispersed in water and which preparation utilizes nonionic dispersants, and optionally an ionic surfactant;

(iii) blending the prepared resin dispersed as a latex with two, or optionally three of the different color pigment dispersions of step (ii);

(iv) adding an aqueous solution of counterionic surfactant as a coagulant to the formed resin-pigment blends, while continuously subjecting the mixture to high shear, to induce a homogeneous gel of the flocculated resin-pigments blend;

(v) heating the above sheared gel at temperatures between about 20° C. and about 5° C. below the glass transition temperature (Tg) of the resin while continuously stirring at speeds between about 200 and about 500 revolutions per minute to form statically bound toner sized aggregates between about 2 and about 12 microns in average volume diameter with a narrow size dispersity and with a geometric size distribution (GSD) between 1.10 and 1.25;

(vi) heating the statically bound aggregated particles at temperatures of from between 25° C. and 40° C. above the Tg of the resin to form coalesced rigid particles of a toner composition comprised of polymeric resin, and pigment agent; and optionally (vii) separating and drying said toner.

24 Claims, No Drawings

TONER AGGREGATION PROCESSES

BACKGROUND OF THE INVENTION

The present invention is generally directed to toner processes, and more specifically to aggregation and coalescence processes for the preparation of toner compositions. In embodiments, the present invention is directed to the economical preparation of toners without the utilization of the known pulverization and/or classification methods, and wherein toners with an average volume diameter of from about 0.5 to about 25, and preferably from 1 to about 10 microns and narrow GSD characteristics can be obtained. The resulting toners can be selected for known electrophotographic imaging and printing processes, including color processes, and lithography. In embodiments, the present invention is directed to a process comprised of dispersing a resin in the form of an aqueous latex prepared by emulsion polymerization comprised of suspended resin particles of from about 0.05 micron to about 1 micron in volume average diameter in water containing an ionic surfactant and optionally a nonionic surfactant, mixing this resin blend with two or optionally three pigment dispersions of different color prepared in water using nonionic dispersants or optionally an ionic surfactant of the same polarity as that employed to form the latex, adding to this blend an aqueous solution of countercharging ionic surfactant, or coagulant of a concentration from about 0.5 to about 5 percent of the weight of the resin component of the latex, thereby causing flocculation of resin particles and pigment particles, shearing this flocculated gel using a high shear in-line or batch homogenization device, followed by heating, below the glass transition temperature (Tg) of the resin, and stirring of the flocculent sheared mixture which is believed to form statically bound aggregates of from about 0.5 micron to about 10 microns comprised of resin, and pigments and adding additional ionic surfactant as a dispersion stabilizer to the formed aggregate dispersion after the desired particle size is achieved, thereafter heating above the Tg of the resin to generate toner particles with an average particle volume diameter of from about 1 to about 25 microns having a color that is controlled by the quantity of different colored pigments used in the blending stage. It is believed that during the higher temperature heating stage the aggregate particles fuse or coalesce together to form toners. In another embodiment thereof, the present invention is directed to an in situ process comprised of preparing a latex of suspended resin particles, such as PLIOTONE TM, comprised of poly(styrene butadiene) and of particle size ranging from about 0.01 to about 0.5 micron as measured by the Brookhaven nanosizer in an aqueous surfactant mixture containing an anionic surfactant such as sodium dodecylbenzene sulfonate, for example NEOGEN R TM or NEOGEN SC TM, and a nonionic surfactant such as alkyl phenoxy poly(ethylenoxy)ethanol, for example IGEPAL 897 TM or ANTAROX 897 TM, and mixing into this resin a quantity of dispersed pigment, such as HELIOGEN BLUE TM or HOSTAPERM PINK TM, dispersed in water containing an anionic surfactant as indicated herein. This resin-pigment blend is then coagulated by the addition of an effective amount of an aqueous cationic surfactant solution, and a surfactant such as benzalkonium bromide (SANIZOL B-50 TM) can be selected and is appropriate for inducing coagulation. The viscous flocculated or gelled blend is homogenized utilizing a high shearing device such as a Brinkman Polytron, or in-line homogenizer such as the IKA SD-41 device, which on further stirring while heating below the Tg of the resin results in formation of statically bound aggregates ranging in size of from about 0.5 micron to about 10 microns in average diameter size as measured by the Coulter Counter (Microsizer II); and thereafter heating above the Tg of the latex resin to provide for particle fusion or coalescence of the polymer and pigment particles; followed by washing with, for example, hot water to remove surfactant, and drying whereby toner particles comprised of resin and pigment with various particle size diameters can be obtained, such as from 1 to 12 microns in average volume particle diameter. The aforementioned toners are especially useful for the development of colored images with excellent line and solid resolution, and wherein substantially no background deposits are present. While not being desired to be limited by theory, it is believed that the flocculation or aggregation is formed by the neutralization of the resin-pigment mixture by the added cationic surfactant. The high shearing operation ensures the formation of a uniform homogeneous flocculated system, or gel from the initial inhomogeneous dispersion which results from the flocculation action, and this uniform gel ensures the formation of stabilized aggregates that are negatively charged and comprised of the resin and pigment particles of about 0.5 to about 5 microns in volume diameter. Thereafter, heating is applied to fuse the aggregated particles or coalesce the particles into a toner or toners of a particular desired color. Furthermore, in other embodiments the ionic surfactants can be exchanged, such that the resin-pigments mixture contains cationic surfactant and coagulation is induced using an anionic surfactant solution; followed by the ensuing steps as illustrated herein to enable flocculation by homogenization, and form statically bounded aggregate particles by stirring of the homogeneous mixture and toner formation after heating. The latex resin particles, or blend of resin particles, used in the aggregation are chosen for their functional performance in the xerographic process, most particularly in that part of the process involved with fixing the image to the final receptor medium, most usually paper. This necessitates the process being accomplished with a latex prepared from a polymer resin with a controlled molecular weight and molecular weight distribution. As a result, the particle size and Tg of the latex for a toner application is fixed by the resin formulation process, usually emulsion polymerization, and this limits the means to make toners of different sizes from the same latex formulation. More specifically, the utilization of a constant latex surfactant to pigment dispersion counterionic surfactant ratio when aggregating the latex under differing solid loadings ensures a uniform chemical composition of the toner while also providing a means to obtain narrow size distribution toner particles.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with an volume average diameter particle of less than 11 microns and preferably less than about 7 microns, and with narrow geometric size distribution (GSD) of from about 1.2 to about 1.3. Additionally, in some xerographic systems wherein process color is utilized, such as pictorial color applications, small particle size colored toners of from about 3 to about 9 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present, such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns, and with higher pigment loading, such as from about 5 to about 12 percent by weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, with a low gloss image of preferably from about 1 to about 30 gloss, low gloss paper is utilized such as from about 1 to about 30 gloss units as measured by the Gardner Gloss metering unit, and, which after image formation with small particle size toners of from about 3 to about 5 microns and fixing, thereafter results in a low gloss toner image of from about 1 to about 30 gloss units as measured by the Gardner Gloss metering unit. Alternatively, if higher image gloss is desired, such as from about 30 to about 60 gloss units as measured by the Gardner Gloss metering unit, higher gloss paper is utilized such as from about 30 to about 60 gloss units, and, which after image formation with small particle size toners of the present invention of from about 3 to about 5 microns and fixing, thereafter results in a higher gloss toner image of from about 30 to about 60 gloss units as measured by the Gardner Gloss metering unit. The aforementioned toner to paper matching can be attained with small particle size toners, such as less than 7 microns and preferably less than 5 microns, such as from about 1 to about 4 microns, such that the pile height of the toner layer(s) is low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In such processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9, and preferably 5 microns are attained without resorting to classification processes, and wherein narrow geometric size distributions are attained, such as from about 1.16 to about 1.35, and preferably from about 1.16 to about 1.30. High toner yields are also attained such as from about 90 percent to about 98 percent in embodiments. In addition, by the toner particle preparation process of this invention, small particle size toners of from about 3 microns to about 7 microns can be economically prepared in high yields such as from about 90 percent to about 98 percent by weight based on the weight of all the toner material ingredients.

There is illustrated in U.S. Pat. No.4,996, 127 a toner of associated particles of secondary particles comprising primary particles of a polymer having acidic or basic polar groups and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of acrylic acid polar group, see Comparative Example I. The process of the present invention need not utilize polymers with polar acid groups, and toners can be prepared with resins such as poly(styrenebutadiene) or PLIOTONE TM without containing polar acid groups. Additionally, the toner of the '127 patent does not utilize counterionic surfactant and flocculation process as does the present invention. In U.S. Pat. No. 4,983,488, a process is disclosed for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate which results in the formation of particles with wide GSD. Furthermore, the '488 patent does not disclose the process of counterionic flocculation as the present invention. Similarly, the aforementioned disadvantages are noted in other prior art, such as U.S. Pat. No. 4,797,339, wherein there is disclosed a process for the preparation of toners by resin emulsion polymerization, wherein similar to the '127 patent polar resins of opposite charges are selected, and wherein flocculation as in the present invention is not believed to be disclosed; and U.S. Pat. No. 4,558,108, wherein there is disclosed a process for the preparation of a copolymer of styrene and butadiene by specific suspension polymerization. Other patents mentioned are U.S. Pat. Nos.3,674,736; 4,137,188 and 5,066,560.

In U.S. Pat. No. 5,290,654, the disclosure of which is totally incorporated herein by reference, there is disclosed a process for the preparation of toners comprised of dispersing a polymer solution comprised of an organic solvent and a polyester, and homogenizing and heating the mixture to remove the solvent and thereby form toner composites. Additionally, there is disclosed in U.S. Pat. No. 5,278,020, the disclosure of which is totally incorporated herein by reference, a process for the preparation of in situ toners comprising a halogenization procedure which chlorinates the outer surface of the toner and results in enhanced blocking properties. More specifically, this patent application discloses an aggregation process wherein a pigment mixture containing an ionic surfactant is added to a resin mixture containing polymer resin particles of less than 1 micron, nonionic and counterionic surfactant, and thereby causing a flocculation which is dispersed to statically bound aggregates of about 0.5 to about 5 microns in volume diameter as measured by the Coulter Counter, and thereafter heating to form toner composites or toner compositions of from about 3 to about 7 microns in volume diameter and narrow geometric size distribution of from about 1.2 to about 1.4, as measured by the Coulter Counter, and which exhibit, for example, low fixing temperature of from about 125° C. to about 150° C., low paper curling, and image to paper gloss matching.

In copending patent application U.S. Ser. No. 989,613 (D/92576), the disclosure of which is totally incorporated herein by reference, there is illustrated a process for the preparation of toner compositions, which comprises generating an aqueous dispersion of toner fines, ionic surfactant and nonionic surfactant; adding thereto a counterionic surfactant with a polarity opposite to that of said ionic surfactant; homogenizing and stirring said mixture; and heating to provide for coalescence of said toner fine particles.

In copending patent application U.S. Ser. No. 022,575 (D/92577), the disclosure of which is totally incorporated herein by reference, there is disclosed a process for the preparation of toner compositions comprising (i) preparing a pigment dispersion in a solvent, which dispersion is comprised of a pigment, an ionic surfactant, and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles to form said toner composition comprised of polymeric resin, pigment and optionally a charge control agent.

Disadvantages associated with this process are that there is no way disclosed to obtain toners of different size utilizing the process of U.S. Ser. No. 022,575 (D/92577) the size of the toner being altered only by alteration of the starting latex resin size and composition and the quantity of coagulant added to form the aggregates. When toner particles are made by varying the coagulant/resin ratio the chemical composition of the obtained toner, particularly the surface properties of the toner can differ from one aggregate size to another, this can lead to critical differences in the xerographic behavior of the material as the xerographic toner charging process is very dependent on the toner surface chemistry.

SUMMARY OF THE INVENTION

It is an object of the present invention to provide toner processes with many of the advantages illustrated herein.

In another object of the present invention there are provided simple and economical processes for the direct preparation of a wide range of colored toner compositions with, for example, excellent pigment dispersion and narrow GSD.

In another object of the present invention there are provided simple and economical in situ processes for colored toner compositions by an aggregation process comprised of (i) preparing a latex mixture comprised of a polymer resin, anionic surfactant and nonionic surfactant; (ii) preparing a number of pigment dispersions, each containing pigment particles of a different color, and optionally charge control agents and other known optional toner additives dispersed in water with a nonionic dispersant and optionally an anionic surfactant; (iii) blending the resin and pigment dispersions thoroughly; (iv) adding a solution of cationic surfactant to the resin-pigment blend to induce flocculation; (v) homogenizing the flocculated suspension by subjecting it to intense shearing using an in-line homogenizing apparatus; (vi) heating the homogenized resin-pigments blend while continuously stirring to form electrostatically stable aggregates of from about 0.5 to about 5 microns in volume average diameter as measured by the Coulter Counter; (vii) optionally adding an aqueous solution of anionic surfactant to stabilize the particles against further aggregation when the temperature is increased in the following particle coalesce stage of the process; and (viii) heating the resulting suspension to temperatures about above the Tg of the resin to induce coalescence or fusing of the aggregate particle mixture into toner composites, or a toner composition comprised of resin, pigment and charge additive.

In a further object of the present invention there is provided a process for the preparation of toners with an average particle diameter of from between about 0.5 to about 20 microns, and preferably from about 1 to about 10 microns, including from 1 to 7 microns, and with a narrow GSD of from about 1.15 to about 1.35 and preferably from about 1.2 to about 1.3 as measured by the Coulter Counter.

Moreover, in a further object of the present invention there is provided a process for the preparation of toners which after fixing to paper substrates result in images with gloss of from 20 Gardner Gloss Units (GGU) up to 70 GGU as measured by Gardner Gloss meter matching of toner and paper.

In another object of the present invention there are provided composite polar or nonpolar toner compositions in high yields of from about 90 percent to about 100 percent by weight of toner without classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with high projection efficiency such as from about 75 to about 95 percent efficiency as measured by the Match Scan II spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles with a combination of pigment particles dispersed in water with nonionic dispersant and optionally a surfactant, and wherein the aggregated particles of toner size can then be caused to coalesce by, for example, heating. In embodiments, factors of importance with respect to controlling particle size and GSD include the concentration of the surfactant used to aggregate the blend of latex and pigment dispersions, the quantity of the latex solids in the suspension, the temperature and time of the aggregation process.

These and other objects of the present invention are accomplished in embodiments by the provision of toners and processes thereof. In embodiments of the present invention, there are provided processes for the economical direct preparation of toner compositions by improved flocculation or heterocoagulation, and coalescence processes; and wherein the amount of cationic surfactant solution selected as coagulant is in proportion to the anionic surfactant present in the latex resin and pigment mixture and the final toner particle size, that is average volume diameter and GSD are controlled by varying the solids loading of the latex dispersion in the range of from about 40 percent to about 2 percent, and preferably from about 30 percent to about 5 percent.

In embodiments the present invention is directed to processes for the preparation of toner compositions, which comprises initially attaining or generating a resin dispersion comprised of polymer particles, such as poly(styrene butadiene) or poly(styrene butylacrylate), and of particle size ranging from 0.01 to about 0.5 micron in volume average diameter, in an aqueous surfactant mixture containing an anionic surfactant such as sodium dodecylbenzene sulfonate and a nonionic surfactant; generating a number of surfactant stabilized pigment dispersions, for example by dispersing water pigments such as phthalocyanine, quinacridone or Rhodamine B type with an anionic surfactant such as sodium dodecyl sulfonate by simple mixing; then adding a solution of counter charging surfactant solution such as benzyl ammonium chloride to induce flocculation and aggregation, and by means of utilizing a high shearing device such as an intense homogenization device such as the in-line IKA SD-41 to ensure that the coagulated blend is homogeneous and uniformly dispersed; thereafter heating below the Tg of the resin while continuously stirring the mixture using a mechanical stirrer at between 250 to 800 rpm; and allowing the formation of electrostatically stabilized aggregates ranging from about 0.5 micron to about 10 microns; and heating from about 60° to about 95° C. to provide for particle fusion or coalescence of the polymer and pigment particles; followed by washing with, for example, hot water to remove surfactant, and drying such as by use of an Aeromatic fluid bed dryer whereby toner particles comprised of resin and pigment with various particle size diameters can be obtained, such as from about 1 to about 10 microns in average volume particle diameter as measured by the Coulter Counter.

Embodiments of the present invention include a process for the preparation of toner compositions comprising (i) preparing a pigment dispersion in water, which dispersion is comprised of a pigment between 1 and 50 percent by weight and preferably between 5 and 25 percent by weight of the total dispersion comprising pigment, water, an ionic surfactant and optionally a charge control agent;

(ii) shearing the pigment dispersion with a resin in the latex form prepared with an ionic surfactant of the same charging polarity to that used in formulating the pigment dispersion, a nonionic surfactant and then aggregating the resin-pigment blend using an aqueous solution of a counterionic surfactant;

(iii) heating the resulting blend at temperatures between 20° C. and 5° C. about below the Tg, for example in the range of from between about 50° C. and about 70° C., to form statically bound aggregates of between 1 and 10 microns in average volume diameter with a GSD of between 1.10 and 1.30; then optionally adding additional ionic surfactant in a quantity of from between about 0.1 and about 2.0 percent by weight of the total suspension to stabilize the aggregates while they are subject to further heating to form coalesced toner particles in step (iv) below; and (iv) heating the statically bound aggregated particles at temperatures between 20° C. and 45° C. about above the resin Tg, for example in the range of from about between 50° C. and 70° C. to form the toner composition comprised of polymeric resin, pigment and optionally a charge control agent, the toner size being in the range of about 1 to about 12 microns in average volume diameter with a GSD in the range from 1.10 to 1.30 in embodiments.

Also, in embodiments the present invention is directed to processes for the preparation of toner compositions which comprises (i) preparing an ionic surfactant stabilized by dispersing a pigment such as Solvent Yellow 17, HOSTAPERM PINK TM, or PV FAST BLUE TM of from about 2 to about 10 percent by weight of the final toner mass in an aqueous mixture containing an anionic surfactant such as sodium dodecylsulfate, dodecylbenzene sulfonate or NEOGEN R TM, of from about 0.5 to about 2 percent by weight of water utilizing a high shearing device such as a Brinkman Polytron or IKA homogenizer at a speed of from about 3,000 revolutions per minute to about 10,000 revolutions per minute for a duration of from about 1 minute to about 120 minutes; (ii) adding the aforementioned ionic pigment mixtures to an aqueous suspension of resin particles comprised of, for example, poly(styreneobutylmethacrylate), PLIOTONE TM or poly(styrene-butadiene) of from about 88 percent to about 98 percent by weight of the toner, and of about 0.1 micron to about 1.0 micron polymer particle size in volume average diameter, and a polarity surfactant With polarity like that used to formulate the pigment dispersion, such as an anionic surfactant such as sodium dodecylsulfate, dodecylbenzene sulfonate or NEOGEN R TM from about 0.5 to about 2 percent by weight of water, a nonionic surfactant, such polyethylene glycol or polyoxyethylene glycol nonyl phenyl ether or IGEPAL 897 TM obtained from GAF Chemical Company, of from about 0.5 to about 3 percent by weight of water; then (iii) aggregating or coagulating the latex-pigments blend by the addition of an aqueous solution comprised of water of cationic surfactant, a surfactant of opposite polarity to that employed in the formulation of the pigment and resin dispersions, such as dialkylbenzene dialkylammonium chloride like SANIZOL B-50 TM available from Kao or MIRAPOL TM available from Alkaril Chemicals, thereby causing a flocculation or coagulation of pigment, charge control additive and resin particles; (iv) homogenizing the resulting flocculent mixture with a high shearing device, such as a Brinkman Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment; (v) further stirring with a mechanical stirrer of from about 250 to 500 rpm while heating in the range from 20° C. to 5° C. below the Tg of the resin to form electrostatically stable aggregates of from about 0.5 micron to about 10 microns in volume average diameter, then optionally adding additional ionic surfactant in effective amounts of, for example, from about between 0.1 to 1 percent by weight of the total mass of the formulation to stabilize the further growth of the particles; (vi) heating the statically bound aggregate particles of from about 10° C. to about 40° C. above the Tg of the resin and for a duration of about 60 minutes to about 600 minutes to form toner sized particles of from about 3 microns to about 12 microns in average volume diameter and with a geometric size distribution of from about 1.1 to about 1.4 as measured by the Coulter Counter; and (vii) isolating the toner sized particles by washing, filtering and drying thereby providing a toner composition. Flow additives to improve flow characteristics and charge additives to improve charging characteristics may then optionally be added by blending with the toner, such additives including AEROSILS® or silicas, metal oxides like tin, titanium and the like, of from about 0.1 to about 10 percent by weight of the toner.

One preferred method of obtaining a pigment dispersion depends on the form of the pigment utilized. In some instances, pigments are available in the wet cake or concentrated form containing water; they can be easily dispersed utilizing a homogenizer or simply by stirring. In other instances, pigments are available only in a dry form, whereby dispersion in water is effected by microfluidizing using, for example, a M-110 microfluidizer and passing the pigment dispersion from 1 to 10 times through the chamber, or by sonication, such as using a Branson 700 sonicator, with the optional addition of dispersing agents such as the aforementioned ionic or nonionic surfactants.

Illustrative examples of resin particles selected for the process of the present invention include known polymers selected from the group consisting of poly(styrene-butadiene), poly(para-methyl styrenebutadiene), poly(meta-methyl styrene-butadiene), poly(alpha-methyl styrene-butadiene), poly(methylmethacrylateobutadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); and terpolymers such as poly(styrene-butadiene-acrylic acid), poly(styrene-butadiene-methacrylic acid), PLIOTONE TM available from Goodyear, polyethylene-terephthalate, polypropyleneoterephthalate, polybutylene-terephthalate, polypentylene-terephthalate, polyhexalene-terephthalate, polyheptadene-terephthalate, polyoctalene-terephthalate, POLYLITE TM (Reichhold Chemical Inc), PLASTHALL TM (Rohm & Hass), CYGAL TM (American Cyanamide), ARMCO TM (Armco Composites), ARPOL TM (Ashland Chemical), CELANEX TM (Celanese Eng), RYNITE TM (DuPont), and STYPOL TM. The resin particles selected, which generally can be in embodiments styrene acrylates, styrene butadienes, styrene methacrylates, or polyesters are present in various effective amounts, such as from about 70 weight percent to about 98 weight and preferably between 80 and 92 percent of the toner, and can be of small average particle size such as from about 0.01 micron to about 1 micron in average volume diameter as measured by the Brookhaven nanosize particle analyzer. Other effective amounts of resin can be selected. P The resin particles selected for the process of the present invention are preferably prepared by emulsion polymerization techniques, and the monomers utilized in such processes can be selected from the group consisting of styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional and such groups can be present in various amounts of from about 0.1 to about 10 percent by weight of the polymer resin. Chain transfer agents such as dodecanethiol or carbon tetrabromide, can also be selected when preparing resin particles by emulsion polymerization. Other processes of obtaining resin particles of from about 0.01 micron to about 1 micron can be selected from polymer microsuspension process, such as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes.

Various known colorants or pigments present in the toner in an effective amount of, for example, from about 1 to about 25 percent by weight of the toner, and preferably in an amount of from about 1 to about 15 weight percent, that can be selected include known cyan, magenta, yellow, red, green, and blue pigments. Specific examples of pigments include phthalocyanine HELIOGEN BLUE L6900 TM, D6840 TM, D7080 TM, D7020 TM, PYLAM OIL BLUE TM, PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E.D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. The pigments selected are present in various effective amounts, such as from about 1 weight percent to about 65 weight and preferably from about 2 to about 12 percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, and the like.

Surfactants in amounts of, for example, 0.1 to about 25 and preferably from about between 0.2 and 10 weight percent in embodiments include, for example, nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenac as IGEPAL CA-210 TM, IGEPAL CA-520 TM, IGEPAL CA-720 TM, IGEPAL CO-890 TM, IGEPAL CO-720 TM, IGEPAL CO-290 TM, IGEPAL CA-210 TM, ANTAROX 890 TM and ANTAROX 897 TM. An effective concentration of the nonionic surfactant is, for example, from about 0.01 to about 10 percent by weight, and preferably from about 0.1 to about 5 percent by weight of monomers used to prepare the toner polymer resin.

Examples of anionic surfactants selected for the preparation of toners and the processes of the present invention include, for example, sodium dodecylsulfate (SDS), sodium dodecylbenzene sulfonate, sodium dodecylnaphthalenesulfate, dialkyl benzenealkyl, sulfates and sulfonates, abitic acid, available from Aldrich, NEOGEN R TM, NEOGEN SC TM from Kao and the like. An effective concentration of the anionic surfactant generally employed is, for example, from about 0.01 to about 10 percent by weight, and preferably from about 0.1 to about 5 percent by weight of monomers used to prepare the toner polymer resin.

Examples of the cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL TM and ALKAQUAT TM available from Alkaril Chemical Company, SANIZOL TM (benzalkonium chloride), available from Kao Chemicals, and the like, and mixtures thereof. This surfactant is utilized in various effective amounts, such as for example from about 0.1 to about 5 percent and preferably between about 0.1 and 2 percent by weight of water. Preferably, the molar ratio of the cationic surfactant used for coagulation is related to the total amount of anionic surfactant used in the preparation of the latex and pigment dispersions and is in range of 0.5 to 4, preferably from 0.5 to 2.

Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Percentage amounts of components are based on the total toner components unless otherwise indicated.

The following Examples are being submitted to further define various species of the present invention. These Examples are intended to be illustrative only and are not intended to limit the scope of the present invention. Also, parts and percentages are by weight unless otherwise indicated.

EXAMPLES

Preparation of the Toner Resin

A latex prepared by emulsion polymerization process selected for the preparation of toner particles for the aggregation process of the present invention was prepared in embodiments as follows:

Latex A:

4,920 Grams of styrene, 1,080 grams of butyl acrylate, 120 grams of acrylic acid, 60 grams of carbon tetrabromide and 210 grams of dodecanethiol were mixed with 9,000 grams of deionized water in which 135 grams of sodium dodecyl benzene sulfonate anionic surfactant (NEOGEN R TM which contains 60 percent of active component), 129 grams of polyoxyethylene nonyl phenyl ether-nonionic surfactant (ANTAROX 897 TM —70 percent active), and 60 grams of ammonium persulfate initiator were dissolved. The emulsion was then polymerized at 80° C. for 5 hours. A latex containing 40 percent solids of resin and pigment, and 60 percent nonsolids of water with a latex particle size of 150 nanometers, as measured on Brookhaven nanosizer, was obtained. Tg of solids=53° C., as measured on DuPont DSC. $M_w$=20,000 and $M_n$=6,000 as determined on Hewlett Packard GPC. The aforementioned latex was then selected for the toner preparation of Examples I to III.

Preparation of the Pigment Dispersion

The pigment dispersions selected for the preparation of toner particles for the aggregation process of the present invention were prepared in embodiments as follows:

Pigment Dispersion 1

167 Grams of SUN FAST BLUE TM solution containing 5.85 grams of dry pigment and 161.15 grams of water were mixed with a 250 gram solution of SUN FAST YELLOW TM containing 5.0 grams of dry pigment and 245 grams of water. To the aforementioned mixture of pigment solutions were added 31 milliliters of 20 percent by weight solution of NEOGEN R TM in water and sonified for 5 minutes, and then sheared for 1 minute at 2,000 rpm to obtain a uniform dispersion. This dispersion was then utilized to form the toner in Example I.

Pigment Dispersion 2:

104.25 Grams of SUN FAST BLUE TM solution containing 3.65 grams of dry pigment and a 100.6 gram solution of SUN FAST YELLOW TM containing 2.73 grams of dry pigment and 101.5 grams of water were mixed. To the mixture of pigment solutions obtained were added 15 milliliters of a 20 percent by weight solution of NEOGEN R TM in water and sonified for 5 minutes, and then sheared for 1 minute at 2,000 rpm to obtain a uniform dispersion. This mixture was then utilized to form the toner of Example II.

Pigment Dispersion 3:

15 Grams of REVERSEFLEX YELLOW TM predispersed pigment (Sun Chemicals) containing 6.15 grams of dry pigment were mixed with 7 grams of REVERSEFLEX RED TM predispersed pigment containing 3.0 grams of dry pigment. No additional surfactant was added to the pigment mixture. This mixture was then utilized to form the toner of Example III.

Pigment Dispersion 4:

15 Grams of REVERSEFLEX YELLOW TM predispersed pigment (Sun Chemicals) containing 6.15 grams of dry pigment were mixed with 7 grams of REVERSEFLEX CYAN TM predispersed pigment containing 3.2 grams of dry pigment. No additional surfactant was added to the pigment mixture. This mixture was then utilized to form the toner of Example IV.

Pigment Dispersion 5

15 Grams of REVERSEFLEX YELLOW TM predispersed pigment (Sun Chemicals) containing 6.15 grams of dry pigment were mixed with 5 grams of REVERSEFLEX RED TM predispersed pigment containing 2.2 grams of dry pigment. 1.2 Grams of predispersed carbon black containing 0.6 gram of dry pigment were then added and mixed. No additional surfactant was added to the pigment mixture. This mixture was then utilized to form the toner of Example V.

Pigment Dispersion 6:

15 Grams of REVERSEFLEX RED TM predispersed pigment (Sun Chemicals) containing 6.5 grams of dry pigment were mixed with 7 grams of REVERSEFLEX CYAN TM predispersed pigment containing 3.2 grams of dry pigment. No additional surfactant was added to the pigment mixture. This mixture was then utilized to form the toner of Example VI.

Preparation of Toner Particles

EXAMPLE I (Lime Green)

417 Grams of the above-prepared mixed pigment solution (Pigment 1) and 650 grams of the above-prepared latex (Latex A) were blended together for 2 minutes at 3,000 rpm using a Polytron device. This latex-pigment blend was then added simultaneously with 600 grams of water containing 8.85 grams of the cationic surfactant SANIZOL B TM into a SD-41 continuous blending device which contained 600 grams of water. Homogenization was achieved by running the SD-41 continuously at 10,000 rpm for 8 minutes. This product of latex particles, pigment particles, surfactants, and water was then transferred to a controlled temperature kettle and heated at 45° C. while gently stirring at 550 rpm for 1.5 hours. After 30 minutes at 45° C., the aggregates resulting had an average volume diameter of 4.2 microns with a volume GSD of 1.23 as determined on the Coulter Counter (Microsizer II). After 1.5 hours, the aggregate produced had an average volume diameter of 4.4 microns with a GSD of 1.19 as determined by particle diameter measurements using the Coulter Counter (Microsizer II). At this point 120 milliters of a 20 percent by weight solution of NEOGEN R TM in water was added primarily to prevent the formed aggregates from further aggregating and increasing in size during the following coalescence stage of the process.

The kettle contents were then heated to 85° C. for 4 hours while being gently stirred. The particle size was measured again on the Coulter Counter. Toner particles of 4.3 microns volume average diameter were obtained with a GSD of 1.21 indicating little further growth in the particle size. The particles of the above resin and pigment, which were green in color, were then washed with water and dried. The yield of the toner particles was 98 percent.

EXAMPLE II (Blue- Violet Toner)

209 Grams of the mixed pigment solution (Pigment 2) and 325 grams of the latex (Latex A) were blended together for 2 minutes at 3,000 rpm using a Polytron device. This latex-pigment blend was then added simultaneously with 300 grams of water containing 4.4 grams of the cationic surfactant SANIZOL B50 TM into a SD-41 continuous blending device which contained 300 grams of water. Homogenization was achieved by operating the SD-41 continuously at 10,000 rpm for 8 minutes. The product of latex particles, pigment particles, surfactants, and water was then transferred to a controlled temperature kettle and heated at 45° C. while gently stirring at 550 rpm for 1 hour. After 1 hour, the aggregate produced had an average volume diameter of 4.6 microns with a GSD of 1.19 as determined by particle diameter measurements using the Coulter Counter (Microsizer II). Then 60 milliliters of a 20 percent by weight solution of NEOGEN R TM in water was added to prevent the formed aggregates from further aggregating and increasing in size during the following coalescence stage of the process.

The kettle contents were then heated to 85° C. for 4 hours while being gently stirred. The particle size was measured again on the Coulter Counter. Toner of 4.8 microns average volume diameter was obtained with a GSD of 1.19, indicating little further growth in the particle size. The toner particles which were blue-violet in color were then washed with water and dried. The yield of the toner particles of resin and pigment was 99 percent.

EXAMPLE III (Orange Toner)

22 Grams of the mixed pigment solution (Pigment 3) and 325 grams of the latex (Latex A) were blended together for 2 minutes at 3,000 rpm using a Polytron device. This latex-pigment blend was then added simultaneously with 300 grams of water containing 2.92 grams of the cationic surfactant SANIZOL B50 TM into a SD-41 continuous blending device which contained 300 grams of water. Homogenization was achieved by operating the SD-41 continuously at 10,000 rpm for 8 minutes. The product of latex particles, pigment particles, surfactants, and water was then transferred to a controlled temperature kettle and heated at 45° C. while gently stirring at 550 rpm for 2.0 hours. After 2 hours, the aggregate produced had a volume average diameter of 4.5 microns with a GSD of 1.19 as determined by particle diameter measurements using the Coulter Counter (Microsizer II). At this point, 60 milliliters of a 20 percent by weight solution of NEOGEN R TM in water were added to prevent the formed aggregates from further aggregating and increasing in size during the following coalescence stage of the process.

The kettle contents were then heated to 90° C. for 4 hours while being gently stirred. The particle size was measured again on the Coulter Counter. Toner particles of 4.7 microns volume average diameter were obtained with a GSD of 1.20 indicating little further growth in the particle size. The particles which were orange in color were then washed with water and dried. The yield of the toner particles was 98 percent.

EXAMPLE IV (Green Toner)

22 Grams of the mixed pigment solution (Pigment 4) and 325 grams of the latex (Latex A) were blended together for 2 minutes at 3,000 rpm using a Polytron device. This latex-pigment blend was then added simultaneously with 300 grams of water containing 2.92 grams of the cationic surfactant SANIZOL B50 TM into a SD-41 continuous blending device which contained 300 grams of water. Homogenization was achieved by operating the SD-41 continuously at 10,000 rpm for 8 minutes. The product comprising latex particles, pigment particles, surfactants, and water was then transferred to a controlled temperature kettle and heated at 45° C. while gently stirring at 550 rpm for 2.0 hours. After 2 hours, the aggregate produced had a volume average diameter of 3.8 microns with a GSD of 1.20 as determined by particle diameter measurements using the Coulter Counter (Microsizer II). Thereafter, 60 milliliters of a 20 percent by weight solution of NEOGEN R TM in water was added to prevent the formed aggregates from further aggregating and increasing in size during the following coalescence stage of the process.

The kettle contents were then heated to 90° C. for 4 hours while being gently stirred. The particle size was measured again on the Coulter Counter. Toner particles of 3.8 microns volume average diameter were obtained with a GSD of 1.20 indicating little further growth in the particle size. The particles which were green in color were then washed with water and dried. The yield of the toner particles was 98 percent.

EXAMPLE V (Brown Toner)

23.2 Grams of the mixed pigment solution (Pigment 5) and 325 grams of the latex (Latex A) were blended together for 2 minutes at 3,000 rpm using a Polytron device. This latex-pigment blend was then added simultaneously with 300 grams of water containing 3.0 grams of the cationic surfactant SANIZOL B 50 TM into a SD-41 continuous blending device which contained 300 grams of water. Homogenization was achieved by operating the SD-41 continuously at 10,000 rpm for 8 minutes. The product of latex particles, pigment particles, surfactants, and water was then transferred to a controlled temperature kettle and heated at 45° C. while gently stirring at 550 rpm for 4.0 hours. After 4 hours, the aggregate produced had an average volume diameter of 3.4 microns with a GSD of 1.19 as determined by particle diameter measurements using the Coulter Counter (Microsizer II). Subsequently, 60 milliliters of a 20 percent by weight solution of NEOGEN R TM in water was added to prevent the formed aggregates from further aggregating and increasing in size during the following coalescence stage of the process.

The kettle contents were then heated to 90° C. for 4 hours while being gently stirred. The particle size was measured again on the Coulter Counter. Toner particles of 3.4 microns volume average diameter were obtained with a GSD of 1.20 indicating little further growth in the particle size. The particles, which were brown in color, were then washed with water and dried. The yield of toner particles was 97 percent.

EXAMPLE VI (Violet Toner)

22 Grams of the mixed pigment solution (Pigment 6) and 325 grams of the latex (Latex A) were blended together for 2 minutes at 3,000 rpm using a Polytron device. This latex-pigment blend was then added simultaneously with 300 grams of water containing 2.9 grams of the cationic surfactant SANIZOL B 50 TM into a SD-41 continuous blending device which contained 300 grams of water. Homogenization was achieved by operating the SD-41 continuously at 10,000 rpm for 8 minutes. The product comprising latex particles, pigment particles, surfactants, and water was then transferred to a controlled temperature kettle and heated at 45° C. while gently stirring at 550 rpm for 2.5 hours. After 2.5 hours, the aggregate produced had a volume average diameter of 3.3 microns with a GSD of 1.20 as determined by particle diameter measurements using the Coulter Counter (Microsizer II). At this point, 60 milliliters of a 20 percent by weight solution of NEOGEN R TM in water was added to prevent the formed aggregates from further aggregating and increasing in size during the following coalescence stage of the process.

The kettle contents were then heated to 90° C. for 4 hours while being gently stirred. The particle size was measured again on the Coulter Counter. Toner particles of 3.6 microns volume average diameter were obtained with a GSD of 1.20 indicating little further growth in the particle size. The particles which were violet in color were then washed with water and dried. The yield of the toner particles was 97.5 percent.

In embodiments, as indicated herein custom colored toners can be obtained by dispersing pigments, such as cyan, magenta, and yellow, in a cationic/water solution followed by combination of the pigment solutions in appropriate known amounts to achieve a preselected colored toner.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions comprising:

(i) forming a dispersion of resin in an aqueous ionic surfactant solution from a latex prepared by emulsion polymerization utilizing an ionic surfactant and optionally a nonionic surfactant;

(ii) preparing pigment dispersions in water of three different pigments each of a dissimilar color, each dispersion being comprised of a pigment dispersed in water and which preparation utilizes nonionic dispersants, and optionally an ionic surfactant of the same polarity as that employed in preparing the resin latex of step (i);

(iii) blending the prepared resin dispersed as a latex with two, or optionally three of the different color pigment dispersions of step (ii), the total pigment loading in the water suspension optionally being between 2 and 30 percent by weight of the solid contents of said suspension;

(iv) adding an aqueous solution of counterionic surfactant as a coagulant to the formed resin-pigment blends, while continuously subjecting the mixture to high shear, to induce a homogeneous gel of the flocculated resin-pigments blend;

(v) heating the above sheared gel at temperatures between about 20° C. and about 5° C. below the glass transition temperature (Tg) of the resin while continuously stirring at speeds between about 200 and about 500 revolutions per minute to form statically bound toner sized aggregates between about 2 and about 12 microns in average volume diameter with a narrow size dispersity and with a geometric size distribution (GSD) between 1.10 and 1.25, and subsequently optionally adding additional ionic surfactant optionally in amounts of between 0.01 and 5 percent by weight of the solid content of the suspension, which ionic surfactant is of the same polarity as that utilized to form the resin and pigment dispersions, and wherein the ionic surfactant functions primarily to stabilize the particles against further growth during the following heating stage;

(vi) heating the statically bound aggregated particles at temperatures of from between 25° C. and 40° C. above the Tg of the resin to form coalesced rigid particles of a toner composition comprised of polymeric resin, and pigment agent; and optionally (vii) separating and drying said toner.

2. A process in accordance with claim 1 wherein the ionic surfactant utilized in preparing both the resin and pigment dispersion is a anionic surfactant, and the counterionic surfactant coagulant selected is a cationic surfactant.

3. A process in accordance with claim 1 wherein the ionic surfactant utilized in preparing both the resin and pigment dispersion is a cationic surfactant, and the counterionic surfactant coagulant selected is an anionic surfactant.

4. A process in accordance with claim 1 wherein the resin is selected from the group consisting of poly(styrene-butadiene), poly(para-methyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene) copolymers.

5. A process in accordance with claim 1 wherein the resin is selected from the group consisting of poly(styrene-butadiene-acrylic acid) poly(styrene-butadiene-methacrylic acid), poly(styrene-butyl methacrylate-acrylic acid), or poly(styrene-butyl acrylate-acrylic acid), and polyethylene-terephthalate, polypropylene-terephthalate, polybutylene-terephthalate, polypentylene-terephthalate, polyhexalene-terephthalate, polyheptadene-terephthalate, and polyoctalene-terephthalate.

6. A process in accordance with claim 1 wherein the resin particles utilized in step (ii) are from about 0.01 to 1 micron in volume average diameter.

7. A process in accordance with claim 1 wherein loading of the resin particles in the latex component of the blend utilized in step (iii) is from 5 percent to about 30 percent by weight, and wherein the aggregate particle size that is formed is from about 2 to 15 microns in volume average diameter, the aggregate particle size varying in inverse proportion to the quantity of solid resin in the latex dispersion.

8. A process in accordance with claim 1 wherein the pigment dispersions of step (ii) are accomplished by utilizing dispersions of cyan, magenta, yellow, red, green or blue pigment particles suspended in water with nonionic dispersants.

9. A process in accordance with claim 1 wherein the pigment dispersions of step (ii) are accomplished by microfluidization of dry colored pigments in a microfluidizer or in nanojet for a duration of from about 1 minute to about 120 minutes.

10. A process in accordance with claim 1 wherein the pigment dispersion of step (ii) is accomplished by utilizing an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

11. A process in accordance with claim 1 wherein the pigment particles are from about 0.01 to about 1 micron in volume average diameter.

12. A process in accordance with claim 2 wherein the anionic surfactant is selected from the group consisting of sodium dodecyl sulfate, sodium dodecylbenzene sulfate and sodium dodecylnaphthalene sulfate.

13. A process in accordance with claim 2 wherein the cationic surfactant is a quaternary ammonium salt.

14. A process in accordance with claim 1 wherein the nonionic surfactant concentration is from about 0.1 to about 5 weight percent of the toner components comprising resin and pigments.

15. A process in accordance with claim 2 wherein the anionic surfactant concentration is from about 0.1 to about 5 weight percent of the toner components, and the cationic surfactant coagulant concentration is from 0.1 to about 5 weight percent of the toner comprising resin and pigments.

16. A process in accordance with claim 1 wherein the blending in (iii) is accomplished by homogenizing at from about 1,000 revolution per minute to about 3,000 revolutions per minute for a duration of from about 1 minute to about 60 minutes.

17. A process in accordance with claim 1 wherein the homogenization in (iv) is accomplished by passing the flocculated, or gelled, resin-pigments composition continuously through a high shear in-line homogenizer operating at from about 4,000 revolutions per minute to about 10,000 revolutions per minute for a duration of from about 1 minute to about 60 minutes.

18. A process in accordance with claim 1 wherein the homogenization in (iv) is accomplished by batch homogenization at from about 1,000 revolutions per minute to about 10,000 revolution per minute and for a duration of from about 5 minutes to about 120 minutes.

19. A process in accordance with claim 1 wherein the heating of the blend of latex, pigment, surfactants and optional charge control agent in step (v) is accomplished at temperatures of from about 20° C. to about 5° C. below the Tg of the resin for a duration of from about 0.5 hour to about 6 hours.

20. A process in accordance with claim 1 wherein the concentration of additional ionic surfactant optionally added in step (v) is from 0.1 to 5 weight percent, and preferably between 0.5 and 2 percent of the toner comprising resin and pigment components.

21. A process in accordance with claim 1 wherein the heating in step (vi) of the statically bound aggregate particles to form toner size coalesced particles comprised of pigment, resin and optional charge control agent is accomplished at a temperature of from about 10° C. to about 40° C. above the Tg of the resin and for a duration of from about 1 hour to about 8 hours.

22. A process in accordance with claim 1 wherein the toner particles isolated are from about 1.5 to 15 microns in average volume diameter, and the geometric size distribution is from about 1.15 to about 1.35.

23. A process in accordance with claim 1 wherein there is added to the surface of the isolated toner particles surface additives of metal salts, metal salts of fatty acids, silicas, metal oxides, or mixtures thereof in an amount of from about 0.1 to about 10 weight percent of the obtained toner.

24. A process in accordance with claim 1 wherein the toner is separated by filtration and is washed with warm water, and wherein the surfactants are removed from the toner surface, followed by drying.

* * * * *